US012349791B1

(12) United States Patent
Allen et al.

(10) Patent No.: US 12,349,791 B1
(45) Date of Patent: Jul. 8, 2025

(54) FULL SELF-CLOSING SOFT-CLOSE EQUIPMENT DRAWER FOR LOCKER

(71) Applicant: AIM Design, LLC, Desoto, TX (US)

(72) Inventors: Sam Allen, Maypearl, TX (US); John Allen, Desoto, TX (US)

(73) Assignee: AIM Design, LLC, Desoto, TX (US)

( * ) Notice: Subject to any disclaimer, the term of this patent is extended or adjusted under 35 U.S.C. 154(b) by 157 days.

(21) Appl. No.: 18/186,638

(22) Filed: Mar. 20, 2023

Related U.S. Application Data

(60) Provisional application No. 63/323,272, filed on Mar. 24, 2022.

(51) Int. Cl.
*A47B 88/467* (2017.01)
*A47B 81/00* (2006.01)

(52) U.S. Cl.
CPC ..... *A47B 88/467* (2017.01); *A47B 81/00* (2013.01)

(58) Field of Classification Search
CPC ..... A47B 88/467; A47B 81/00
See application file for complete search history.

(56) References Cited

U.S. PATENT DOCUMENTS 552,441 A * 12/1895 Matthews ..... A47B 88/467 312/331
686,249 A * 11/1901 Beery ..... A47B 88/467 206/214
1,238,514 A * 8/1917 Hartbeck ..... A47B 88/467 109/47
7,780,251 B2 * 8/2010 Dubach ..... A47B 88/457 312/319.1
7,901,017 B1 * 3/2011 Kafferlin ..... A47B 88/467 312/319.1
10,674,822 B1 * 6/2020 Koyama ..... A47B 88/467
11,723,460 B1 * 8/2023 Allen ..... D06F 58/00 211/85.7
2004/0104649 A1 * 6/2004 Muller ..... A47B 88/467 312/333
2006/0214547 A1 * 9/2006 Bonner ..... A47B 88/467 312/319.5
2009/0278430 A1 * 11/2009 Liang ..... A47B 88/467 312/319.1
2010/0007254 A1 * 1/2010 Zimmer ..... E05F 5/027 312/333
2011/0025181 A1 * 2/2011 Vinke ..... A47B 67/04 439/577

(Continued)

FOREIGN PATENT DOCUMENTS

EP 1690473 A2 * 8/2006 ..... A47B 88/40

*Primary Examiner* — Hanh V Tran
(74) *Attorney, Agent, or Firm* — James E. Walton

(57) ABSTRACT

A locker includes a pair of spaced-apart upstanding sidewalls, a back wall, and at least one compartment defined between the upstanding sidewalls. A bottom storage compartment includes a pair of compartment side walls. A perforated compartment back wall and a perforated compartment front plate are connected to the compartment sidewalls. A compartment bottom wall which is connected to the pair of compartment side walls and the compartment front and back walls. A protrusion connected to the bottom of the compartment back plate which is connected by a spring wire to the auto-retracting mechanism attached to the locker back wall.

10 Claims, 9 Drawing Sheets

(56) References Cited

U.S. PATENT DOCUMENTS

| | | | | |
|---|---|---|---|---|
| 2014/0021840 | A1* | 1/2014 | Radusin | A47B 88/467<br>312/334.44 |
| 2016/0258108 | A1* | 9/2016 | Jindra | A47B 81/00 |
| 2018/0146779 | A1* | 5/2018 | Allen | A47B 95/00 |
| 2019/0374838 | A1* | 12/2019 | Allen | A47B 46/005 |
| 2020/0178757 | A1* | 6/2020 | Fawaz | A47L 15/507 |

* cited by examiner

FULL SELF-CLOSING SOFT-CLOSE EQUIPMENT DRAWER FOR LOCKER

This application claims the benefit of U.S. Provisional Application No. 63/323,272, filed 24 Mar. 2022, titled "Full Self-Closing Soft-Close Equipment Drawer for Locker," which is incorporated herein for all purposes.

BACKGROUND

1. Field of the Invention

The present invention relates generally to improvements in lockers or storage cabinets used in athletic or sporting facilities, and more specifically to compartments of such lockers being closed automatically.

2. Description of Related Art

The aesthetics and utility of lockers or storage cabinets in "locker rooms" of athletic and sporting facilities of sports teams and country clubs, for example, have become a measure of the quality and prestige of such organizations and an increasingly important aspect of recruiting new team or club members. Modern lockers are a far cry from the simple wood or metal cabinets of the past.

Modern lockers incorporate storage for specific items of equipment, such as helmets and shoes, and features promoting comfort and luxury. There is a constant need for improvement in both functional and aesthetic aspects of such lockers, including the maintaining the safety of the people in the locker room when using these lockers.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
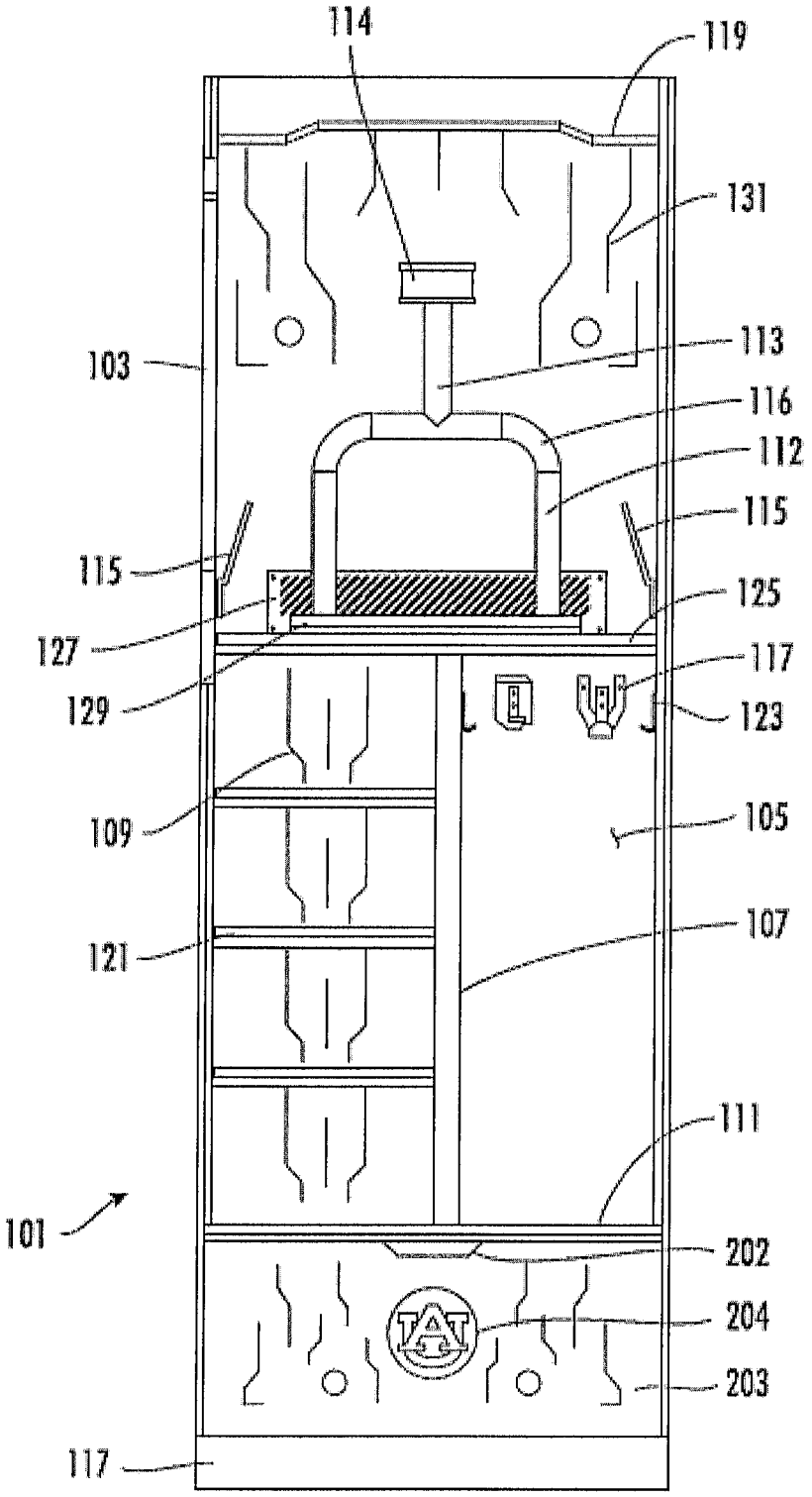
FIG. 1 is a front view of a locker having a bottom storage compartment according to the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the locker and high-speed drying unit of the present application are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Referring now to FIG. 1 in the drawings, a locker 101 according to the present application is illustrated. As can be seen, locker 101 comprises a pair of upstanding sidewalls 103 that are used to define the dimensions of locker 101. These side walls are connected at the back by back wall 105, connected at the bottom by bottom wall 117, and are connected at the top by top wall 119. It will be appreciated that each of these walls may be formed of multiple component parts, each of which may perform additional functions other than merely forming an enclosure, such as ventilation plenums, interconnecting surfaces, ventilation conduits, etc. Each locker may be installed adjacent to another, similar or identical locker, with its rear against a wall, and its front facing the interior of the locker room.

Between sidewalls 103 of locker 101, there is a horizontal panel 125 which divides the inside of the locker into upper and lower sections. The upper section houses a ventilated storage rack 116 which is comprised of a ventilated base 129, a C shaped support 112, an elongated support 113, and a mounting head 114. Ventilated base 129 connects to the top of horizontal panel 125 and contains vents 135 to help maintain airflow through the upper and lower sections of locker 101. The two prongs of C shaped support 112 will connect to the top of ventilated based 129 to provide adequate support for equipment being stored on the rack. Elongated support 113 will be attached to C shaped support 112 and elongated upward to provide enough space to support equipment such as helmets, shoulder pads, and other sport equipment. At the top of elongated support 113 there will be the mounting head 114 which forms a base to support the equipment, mounting head 114 also contains a vented portion 133 as C shaped support 112 and elongated support 113 will be hollow so vented portion 133 of mounting head 114 will allow for airflow into the equipment. On either side of ventilated storage rack 116 there are angled ventilated protrusions 115 attached to side walls 103 where smaller items such as gloves or other pieces of equipment can be mounted for storage. Back wall 105 of the upper section of locker 101 also contains ventilation slots 131 in the upper section of the wall along with a ventilation plate 127 and both are used to maintain air flow through the entire system.

The lower section of locker 101 is further divided by ventilated vertical panel 107 creating a left and right section of the lower part of locker 101. The lower right section has no further compartments in it but does contain hanging racks 117 attached to back wall 105 and hanging racks 123 which are attached to side wall 103 and ventilated vertical panel 107 which can be used to hang clothes or other pieces of equipment. The lower left section is divided into smaller sections by ventilated horizontal panels 121. In these compartments, back wall 105 also contains ventilations 109 to help airflow within the locker. Each of these compartments may be sized and otherwise configured for storage of clothing, sporting equipment, or other items, and may include doors, ventilation grills, sliding components, tilting components, equipment racks, and equipment holders, any of which may be lockable.

Locker 101 also has a horizontal seat 111 which is below the compartments. Beneath the locker seat is bottom storage compartment 201. Front plate 203 of bottom storage compartment 201 can have a logo or emblem 204 attached to the middle of front plate 203 to allow for further customization of locker 101. Front plate 203 of bottom storage compartment 201 will have a groove 202 so that the compartment can be opened and front plate 203 can also have ventilation grills and may be lockable.

Figure 2A:
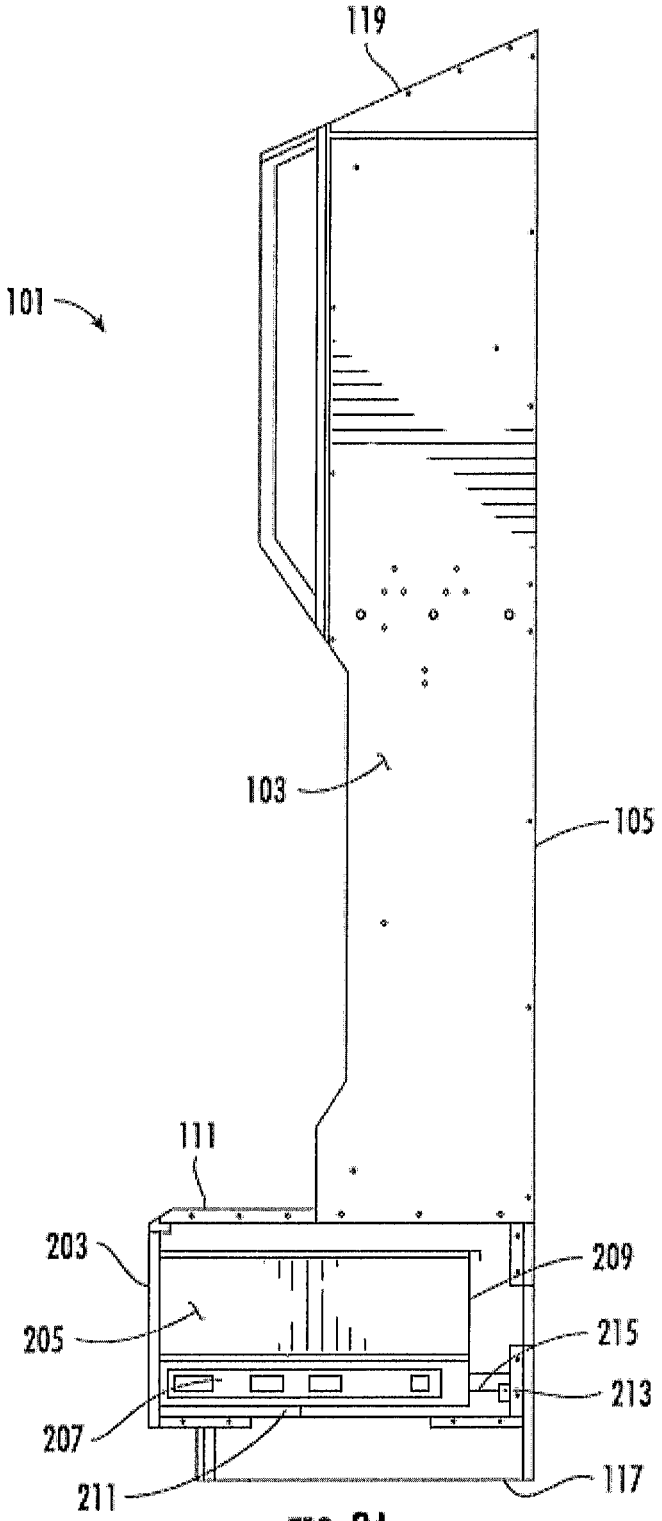
FIG. 2A is a side view of a locker when the bottom storage compartment is not extended out of the locker.
Figure 2B:
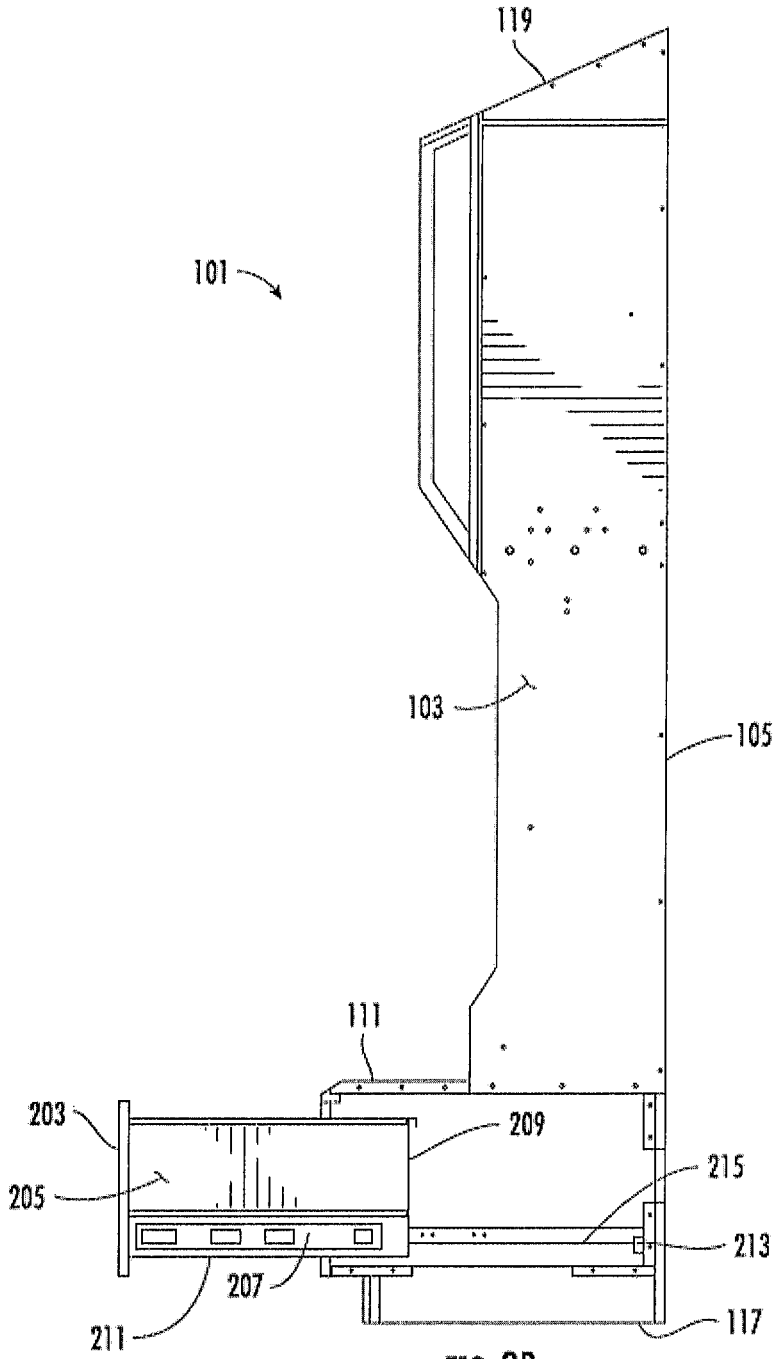
FIG. 2B is a side view of a locker when the bottom storage compartment is extended out of the locker.

Referring now to FIGS. 2A and 2B, the side view of locker 101 is shown with bottom storage compartment 201 as being closed in FIG. 2A and open in FIG. 2B. Bottom storage compartment 201 has a pair of compartment side walls 205 which are connected at the front by front plate 203, at the back by compartment back wall 209, and at the bottom by compartment bottom wall 211. It is appreciated that each of these walls may contain ventilation grills. Attached to compartment back wall 209 is connecting spring wire 215 which connects bottom storage compartment 201 to auto-retraction mechanism 213 which is attached to back wall 105. Auto-retraction mechanism 213 automatically retracts connecting spring wire 215 when bottom storage compartment 201 is open to make it a self-closing system. Attached to compartment side walls 205 are soft-closed drawer slides 207 which are used in conjunction with the self-closing system to prevent bottom storage compartment 201 from closing too quickly and getting damaged.

Figure 3A:
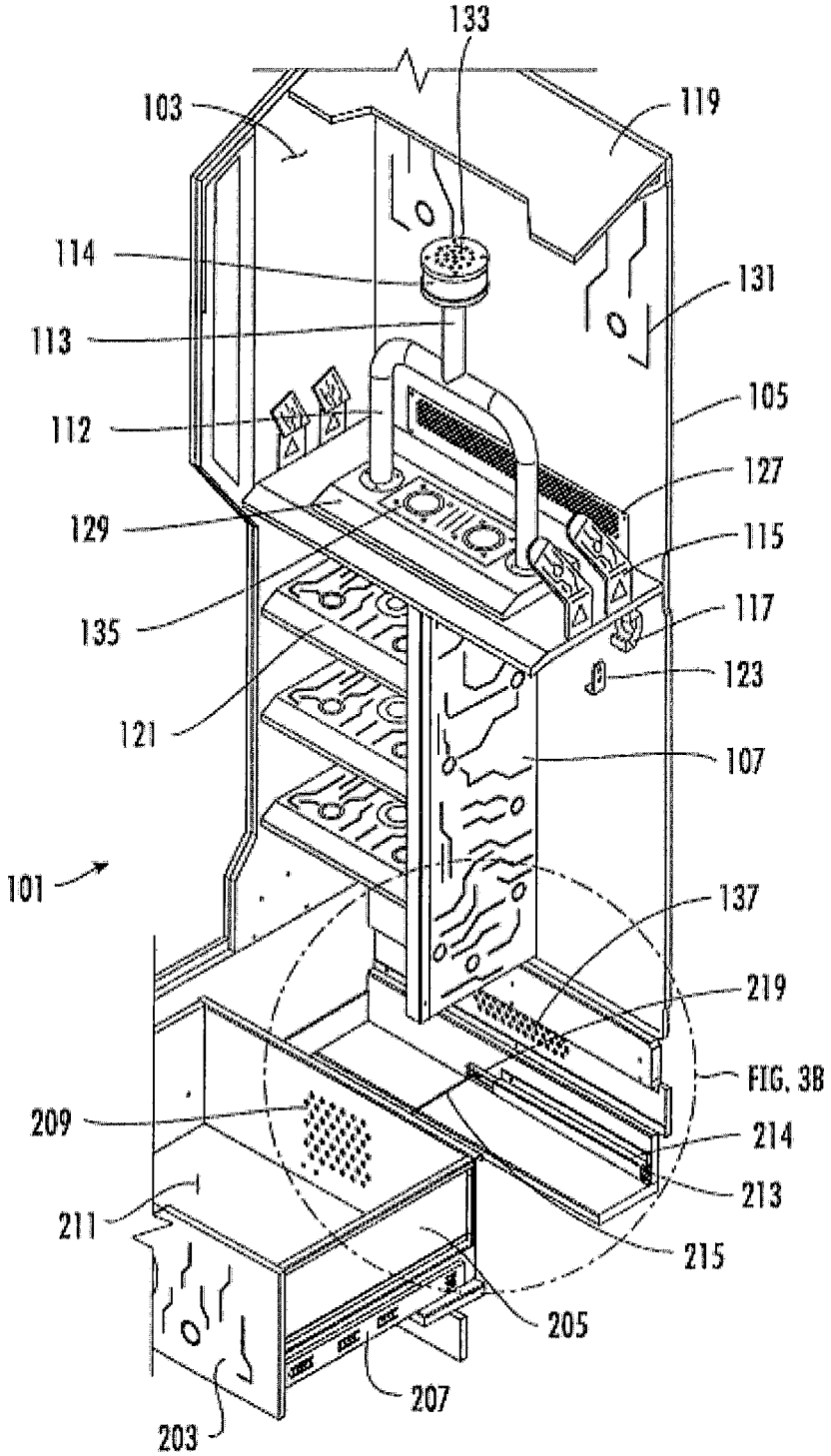
FIG. 3A is a perspective view from the front of a locker when the bottom storage compartment is extended out of the locker.
Figure 3B:
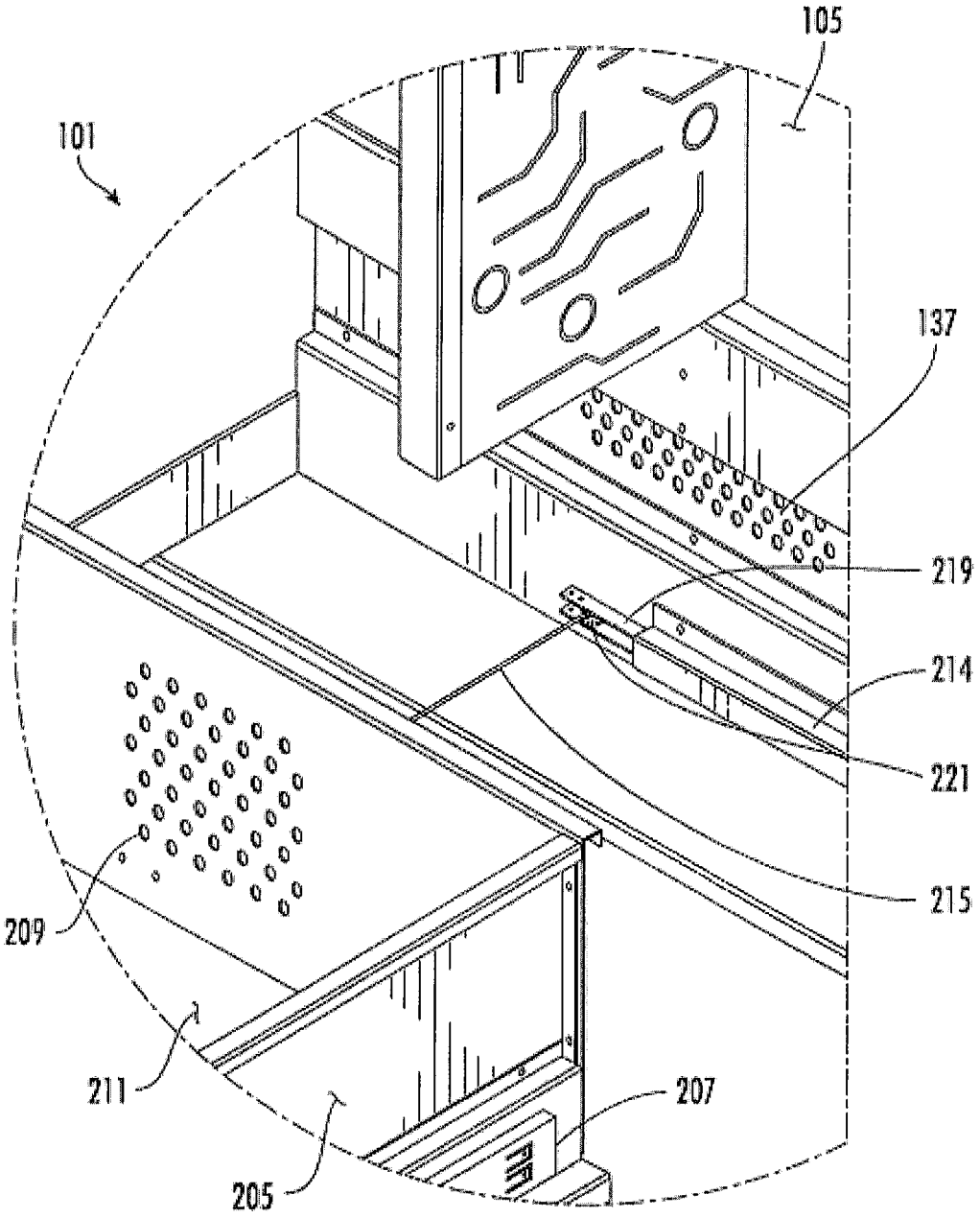
FIG. 3B is an enlarged portion of the bottom storage compartment extended out of the locker in FIG. 3A.

Referring now to FIGS. 3A and 3B, a perspective view of locker 101 along with a blown up view of bottom storage compartment 201 are shown. A better look of locker 101 is seen through this perspective view and it provides a better look of the depth of the locker. This view shows that there is ventilation 137 at the bottom of locker 101 where bottom storage compartment 201 is. This ventilation 137 allows airflow into locker 101 and into bottom storage compartment 201 when it is closed. The blown up view provides a better view of auto-retraction mechanism 213 and how it is connected to back wall 105. Auto-retraction mechanism 213 is comprised of sleeve 214, insert portion 219, protrusions 223, retraction mechanism 221, and spring wire 215. Sleeve 214 is attached to back wall 105 using fasteners and insert portion 219 is inserted into sleeve 214. Protrusions 223 run along the length of insert portion 219 and they are used to adjust the length of insert portion 219 when it is inserted into sleeve 214. At the end of insert portion there is retraction mechanism 221 which is used to store spring wire 215 when it is not extended and to retract it when it is.

Figure 4A:
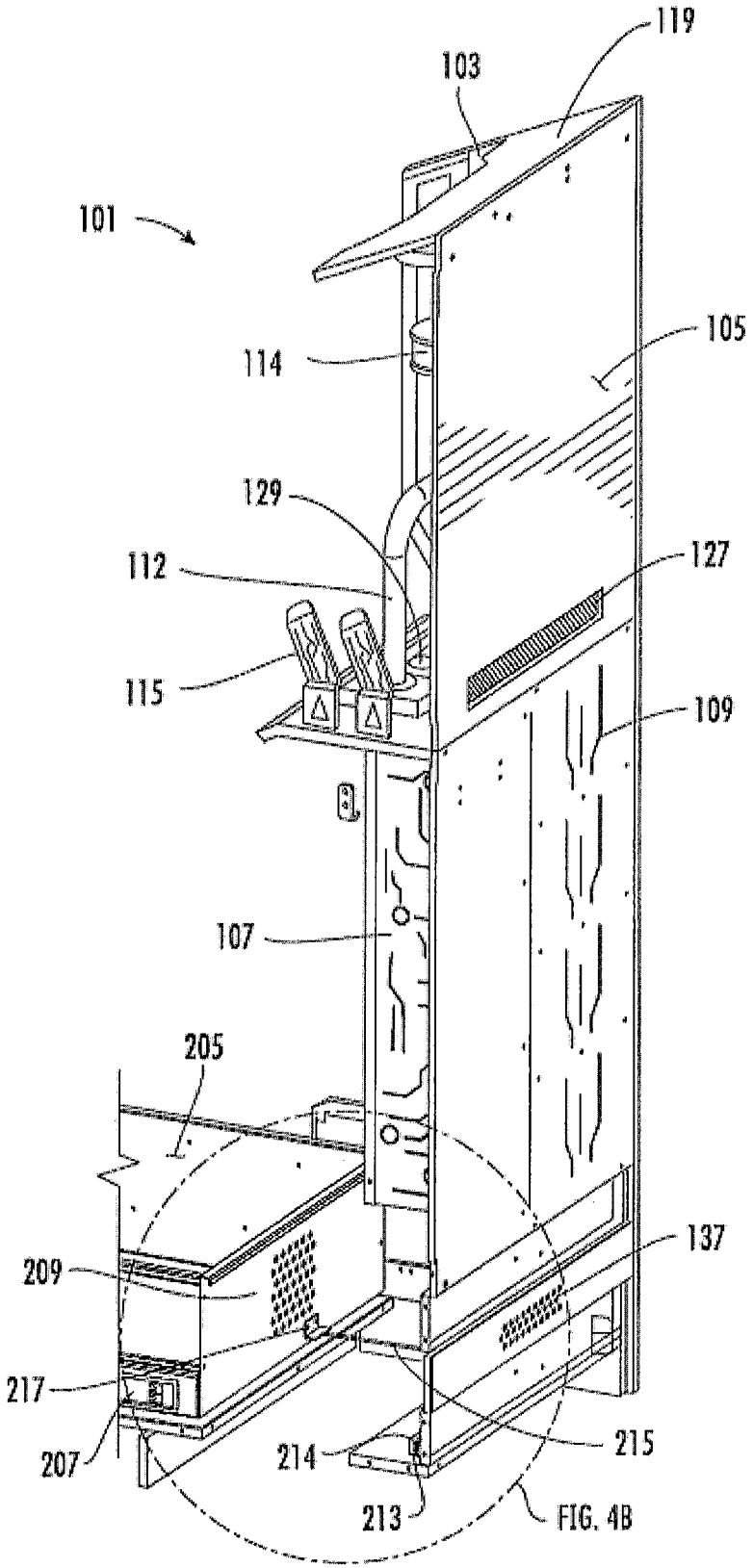
FIG. 4A is a perspective view from the back of a locker when the bottom storage compartment is extended out of the locker.
Figure 4B:
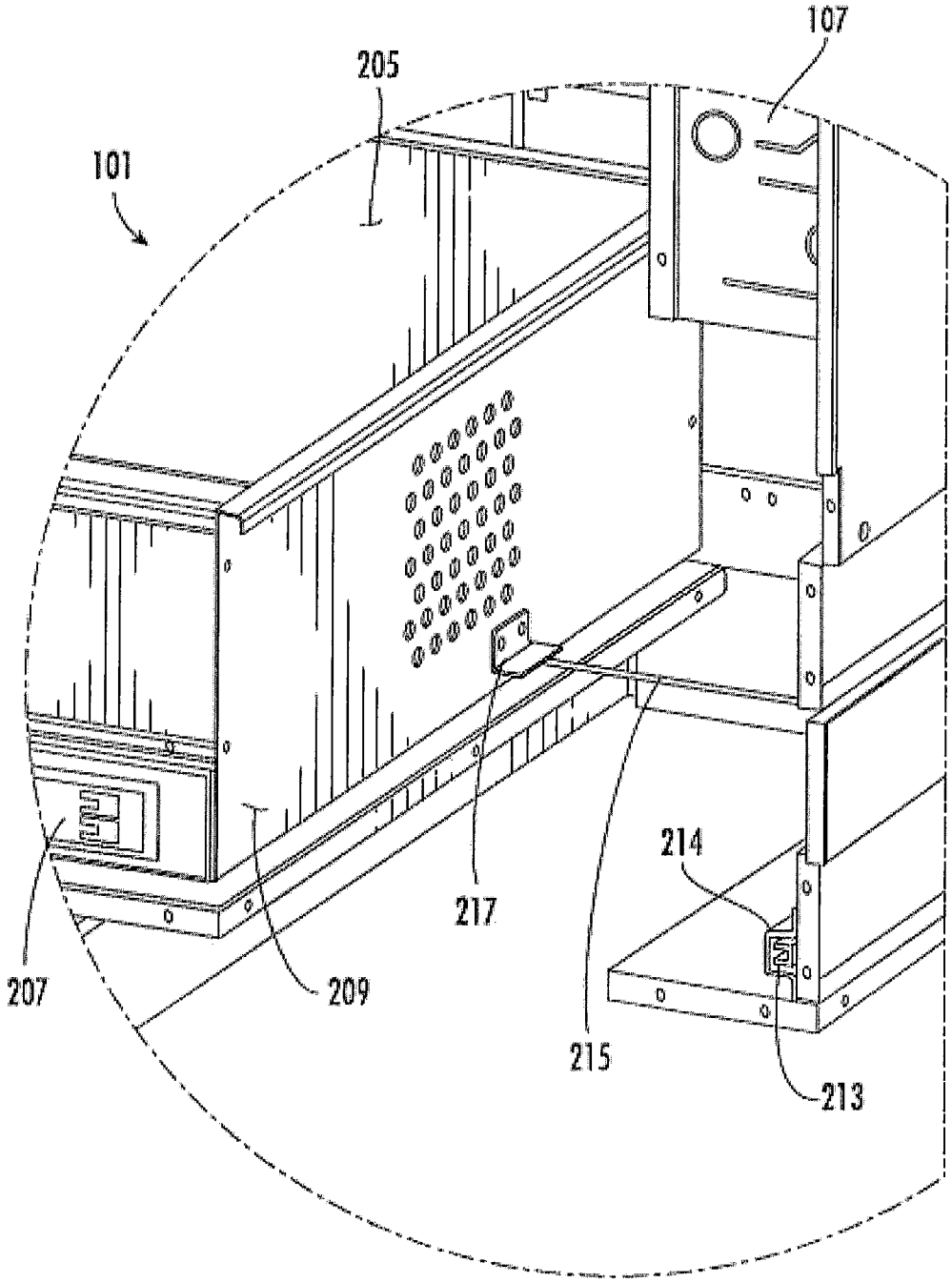
FIG. 4B is an enlarged portion of the bottom storage compartment extended out of the locker in FIG. 4A.

Referring now to FIGS. 4A and 4B, a perspective back view of locker 101 and blown-up view of bottom storage compartment 201 are depicted. Compartment back wall 209 further has bottom compartment protrusion 217 which is attached to the bottom of compartment back wall 209. Bottom compartment protrusion 217 is how spring wire 215 connects bottom storage compartment 201 to auto-retraction mechanism 213.

Figure 5:
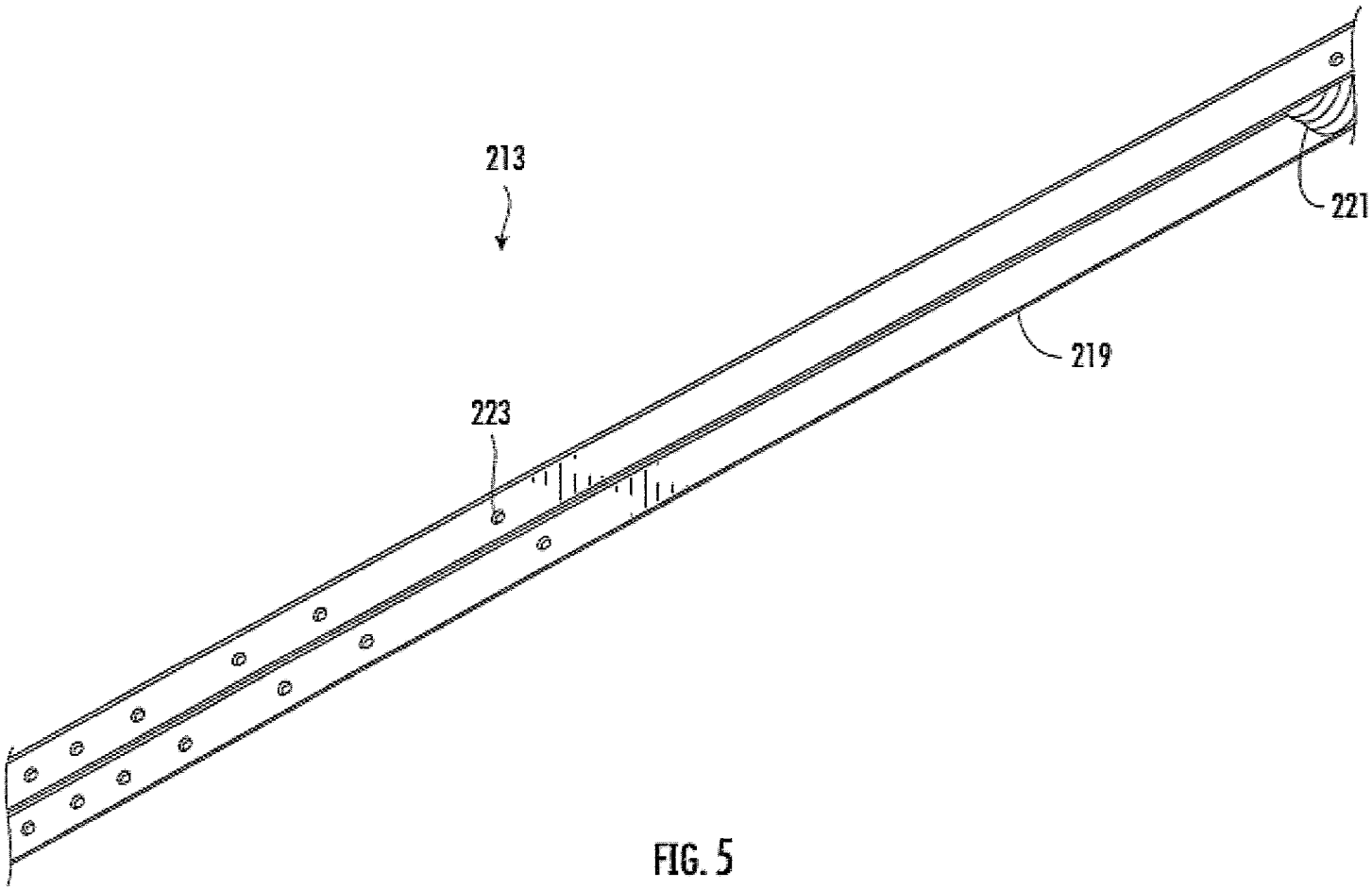
FIG. 5 is a perspective view of the rail that connects the bottom storage compartment to the locker.
Figure 6:
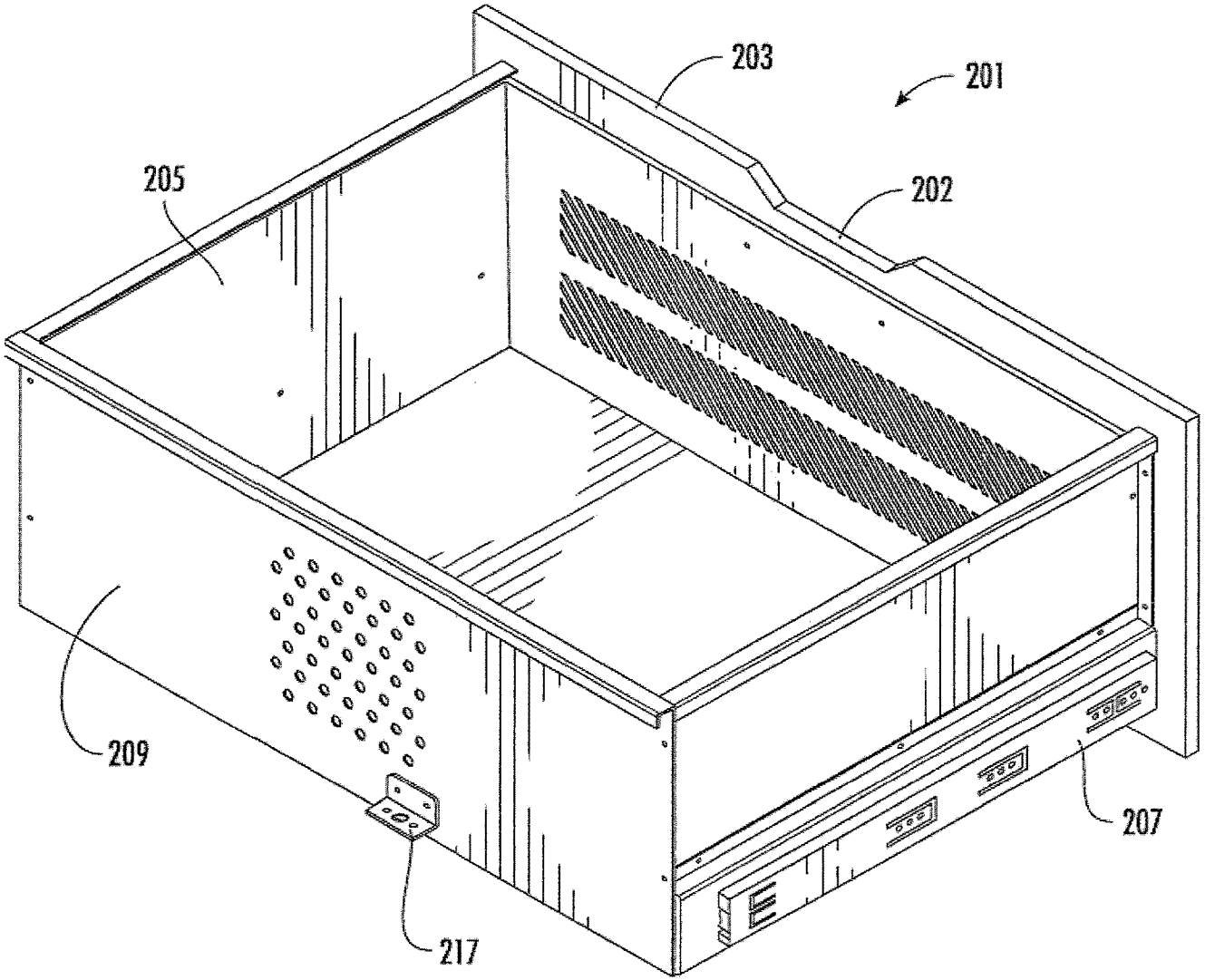
FIG. 6 is a perspective view from the back of the bottom storage compartment.

Referring now to FIGS. 5 and 6, auto-retraction mechanism 214 and bottom storage compartment 201 are depicted. FIG. 5 is a perspective view of auto-retraction mechanism 213. FIG. 6 gives a perspective view of bottom storage compartment 201. This provides an up-close look at bottom storage compartment 201 when it is not a part of locker 101.

It is apparent that a system with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description and claims. Although the present embodiments are shown above, they are not limited to just these embodiments, but are amenable to various changes and modifications without departing from the spirit thereof.

The invention claimed is:

1. A locker, comprising:
- a pair of spaced-apart upstanding sidewalls;
- a back wall extending between the pair of sidewalls;
- at least one compartment defined between the upstanding sidewalls;
- a bottom storage compartment, the bottom storage compartment comprising:
  - a pair of compartment sidewalls;
  - a compartment back wall extending between the pair of compartment sidewalls;
  - a compartment bottom wall extending between the pair of compartment sidewalls and between a front plate and a compartment back wall;
  - a front plate extending between the pair of compartment sidewalls;
  - a pair of soft-closed drawer slides attached to the outer side of the compartment side walls; and
  - a protrusion on the back of the compartment back wall; and
- an auto-retraction mechanism for automatically closing the bottom storage compartment, the auto-retraction mechanism comprising:
  - a sleeve connected to the back wall of the locker;
  - an insert portion having a first end telescopically secured within the sleeve and an exposed second end;
  - sleeve protrusions disposed along a length of the insert portion;
  - a retraction mechanism coupled to the insert portion; and
  - a spring wire at least partially disposed within the retraction mechanism;
- wherein an end of the spring wire not disposed within the retraction mechanism is coupled onto the protrusion of the bottom storage compartment; and
- wherein the sleeve protrusions allow length adjustment of the insert portion relative to the sleeve.

2. The locker according to claim 1, wherein the compartment back wall is at least partially perforated.

3. The locker according to claim 1, wherein the compartment front plate is at least partially perforated.

4. The locker according to claim 1, wherein the upstanding sidewalls may be ventilated.

5. The locker according to claim 1, wherein the back wall may be ventilated.

6. The locker according to claim 1, wherein the compartment defined between the upstanding sidewalls is split into three sections.

7. The locker according to claim 6, further comprising:

an upper portion of the compartment;

a lower right portion of the compartment; and a lower left portion of the compartment split into four sections.

8. The locker according to claim 7, wherein the locker further comprises:

a ventilated storage rack; and at least one angled ventilated protrusion.

9. The locker according to claim 1, wherein the auto-retraction mechanism closes the bottom storage compartment automatically after it is opened.

10. The locker according to claim 1, where the soft-closed drawer slides slows down the bottom storage compartment while it is closing.

* * * * *